US006229973B1

(12) United States Patent
Wang et al.

(10) Patent No.: US 6,229,973 B1
(45) Date of Patent: May 8, 2001

(54) DEVELOPER CONTAINER

(76) Inventors: Jui-Chi Wang; Robin Hsu; Huang Ya-Li; Li Kuan-Tung, all of No. 498, Sec 1, Yung-Shing Rd., Wu-Chi Town, Tai chung County (TW)

( * ) Notice: Subject to any disclaimer, the term of this patent is extended or adjusted under 35 U.S.C. 154(b) by 0 days.

(21) Appl. No.: 09/574,584

(22) Filed: May 17, 2000

(51) Int. Cl.[7] ..... G03G 15/08

(52) U.S. Cl. ..... 399/106; 222/DIG. 1; 399/260; 399/262

(58) Field of Search ..... 222/554, DIG. 1; 399/103, 106, 258, 260, 262

(56) References Cited

U.S. PATENT DOCUMENTS 5,040,024 * 8/1991 Fukuda et al. ..... 399/262
5,249,020 * 9/1993 Takano ..... 399/262
5,337,125 * 8/1994 Nakano et al. ..... 399/262
5,655,179 * 8/1997 Ueda et al. ..... 399/262
5,710,963 * 1/1998 Dirx ..... 399/262
6,018,638 * 1/2000 Li ..... 399/106

* cited by examiner

*Primary Examiner*—Arthur T. Grimley
*Assistant Examiner*—Hoang Ngo
(74) *Attorney, Agent, or Firm*—Pro-Techtor International Services

(57) ABSTRACT

A developer container which includes a connector element connects a container body to an image forming apparatus, and a rotating sealing member rotated in an inside chamber in the connector element to close/open the developer passage through the connector element, wherein the rotating sealing member has a flat shutter board, which closes the developer passage through the connector element when turned with the rotating sealing member to a horizontal position, or opens the developer passage through the connector element when turned with the rotating sealing member from the horizontal position to a vertical position.

2 Claims, 5 Drawing Sheets

DEVELOPER CONTAINER

BACKGROUND OF THE INVENTION

The present invention relates to a developer container for use with an image forming apparatus, and more particularly to a developer passage control arrangement for a developer container.

U.S. Pat. No. 5,649,270 discloses a developer container, which comprises a container portion having an opening through which developer is supplied in or out, a shutter member for opening and closing the opening, a slide guide for guiding the shutter member. This structure of developer container requires much operation space. Further, the shutter member tends to be damaged, stuck, or disconnected from the developer container during its operation. U.S. Pat. No. 6,018,638 discloses a developer container cover with rotary sealing means for a developer container, which is an invention of the present inventor. This design eliminates the drawbacks of the aforesaid developer container. However, because the rotating sealing member is a cylindrical member having a transverse through hole for the passing of the developer when in the open position, less amount of developer is allowed to pass through the connector element.

SUMMARY OF THE INVENTION

The present invention has been accomplished to provide a developer container, which eliminates the aforesaid drawbacks. It is one object of the present invention to provide a developer container, which requires less operation space. It is another object of the present invention to provide a developer container, which can easily and positively turned between the open position and the close position, and enables sufficient amount of developer to be supplied to the image forming apparatus when turned to the open position. According to the present invention, a connector element is provided to connect a container body to an image forming apparatus, and a rotating sealing member is rotated in an inside chamber in the connector element to close/open the developer passage through the connector element. The rotating sealing member has a flat shutter board, which closes the developer passage through the connector element when turned with the rotating sealing member to a horizontal position, or opens the developer passage through the connector element when turned with the rotating sealing member from the horizontal position to a vertical position.

DETAILED DESCRIPTION OF THE PREFERRED EMBODIMENT

Figure 1:
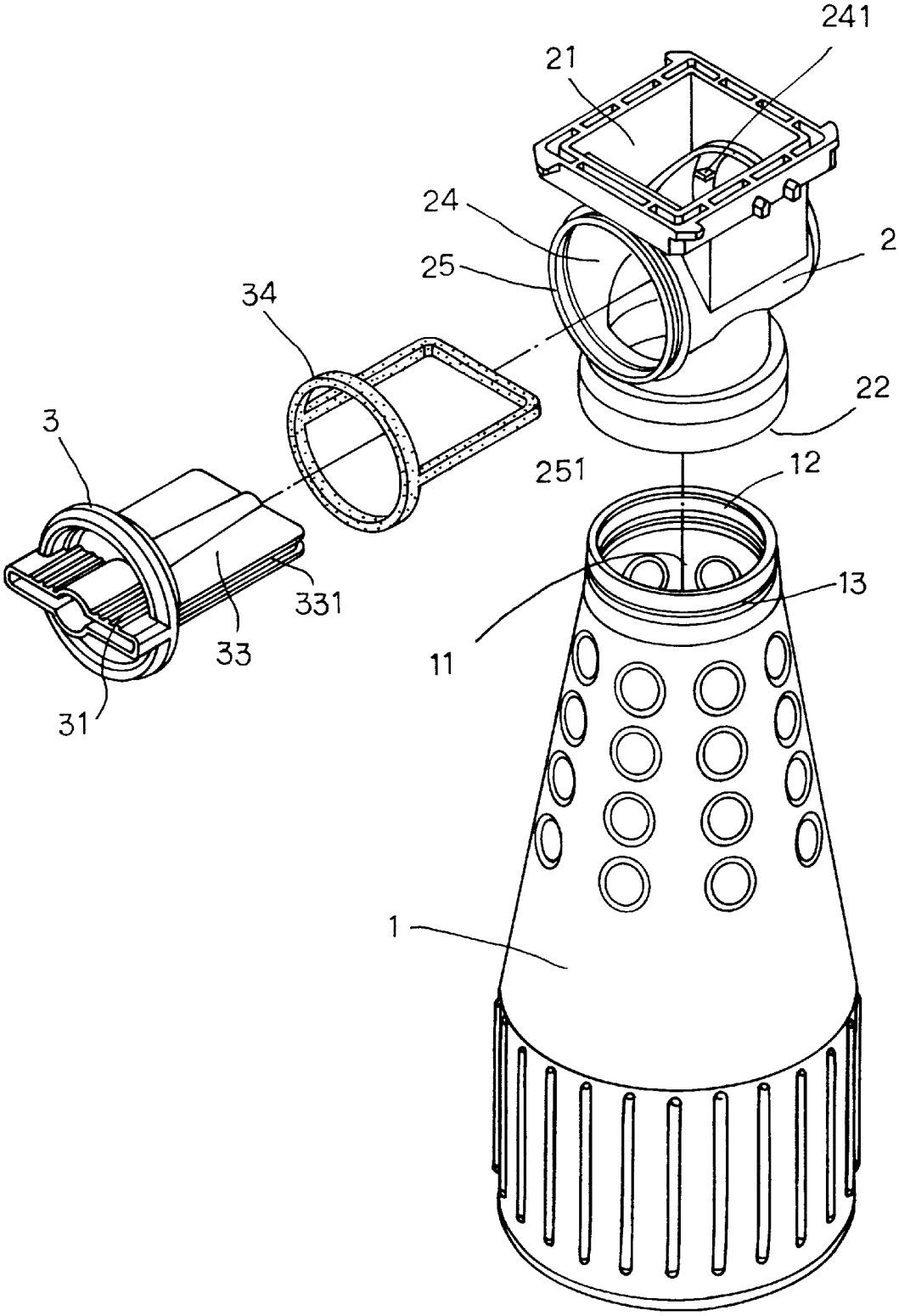
FIG. 1 is an exploded view of a developer container according to the present invention.
Figure 4:
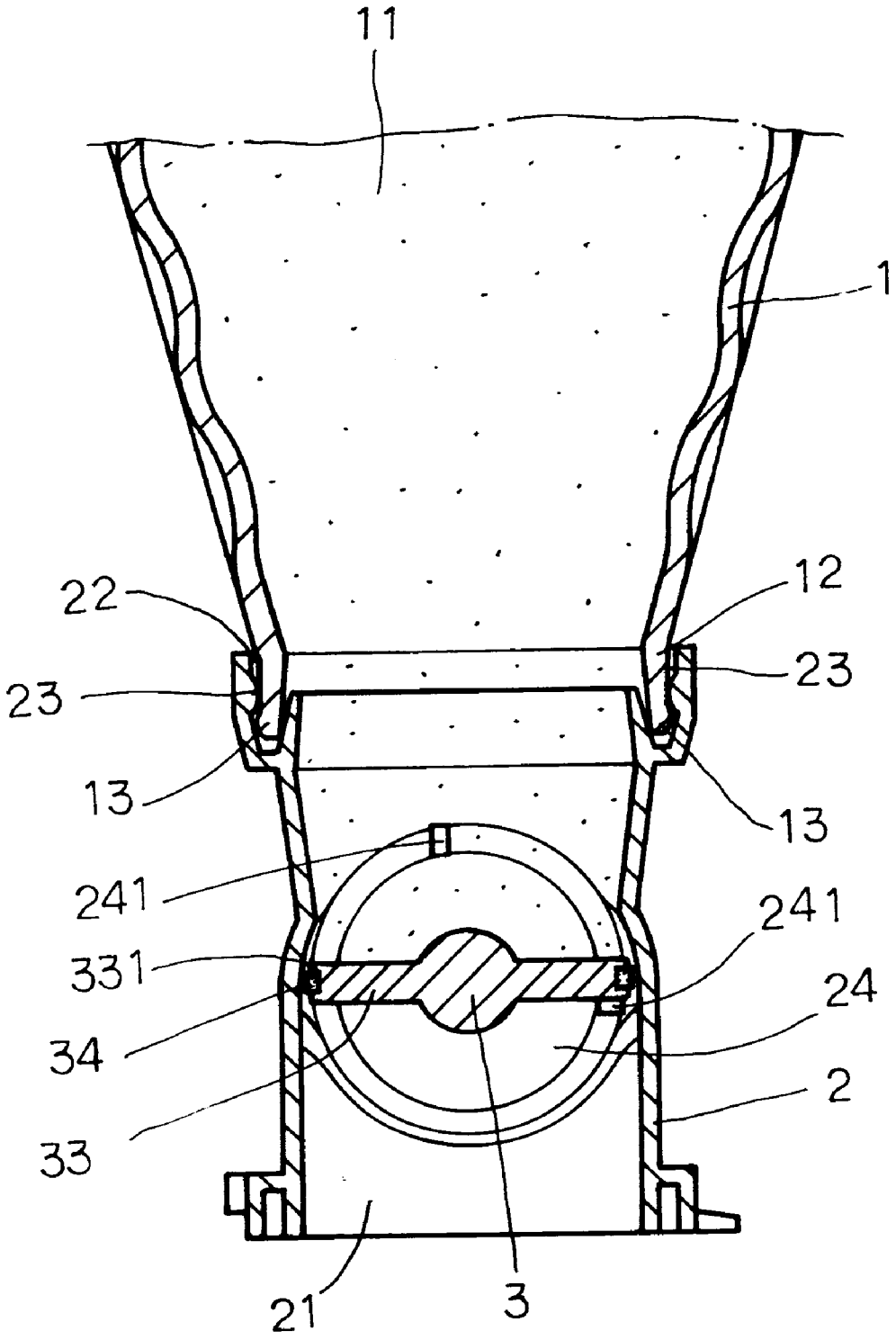
FIG. 4 is a sectional view in an enlarged scale of a part of the present invention, showing the rotating sealing member turned to the horizontal position and the passage between the front supply hole of the connector element and the opening of the container body closed.

Referring to FIGS. 1 and 4, a developer container is shown comprised of a container body 1, a connector element

2 that connects the container body 1 to an image forming apparatus (not shown), and a rotating sealing member 3 mounted in the connector element 2 and turned to close/open the container body 1. The container body 1 comprises a developer chamber 11 holding a developer, an opening 12 at its one end through which the developer is supplied to the image forming apparatus, and an outside annular coupling flange 13 disposed around the opening 12.

Figure 2:
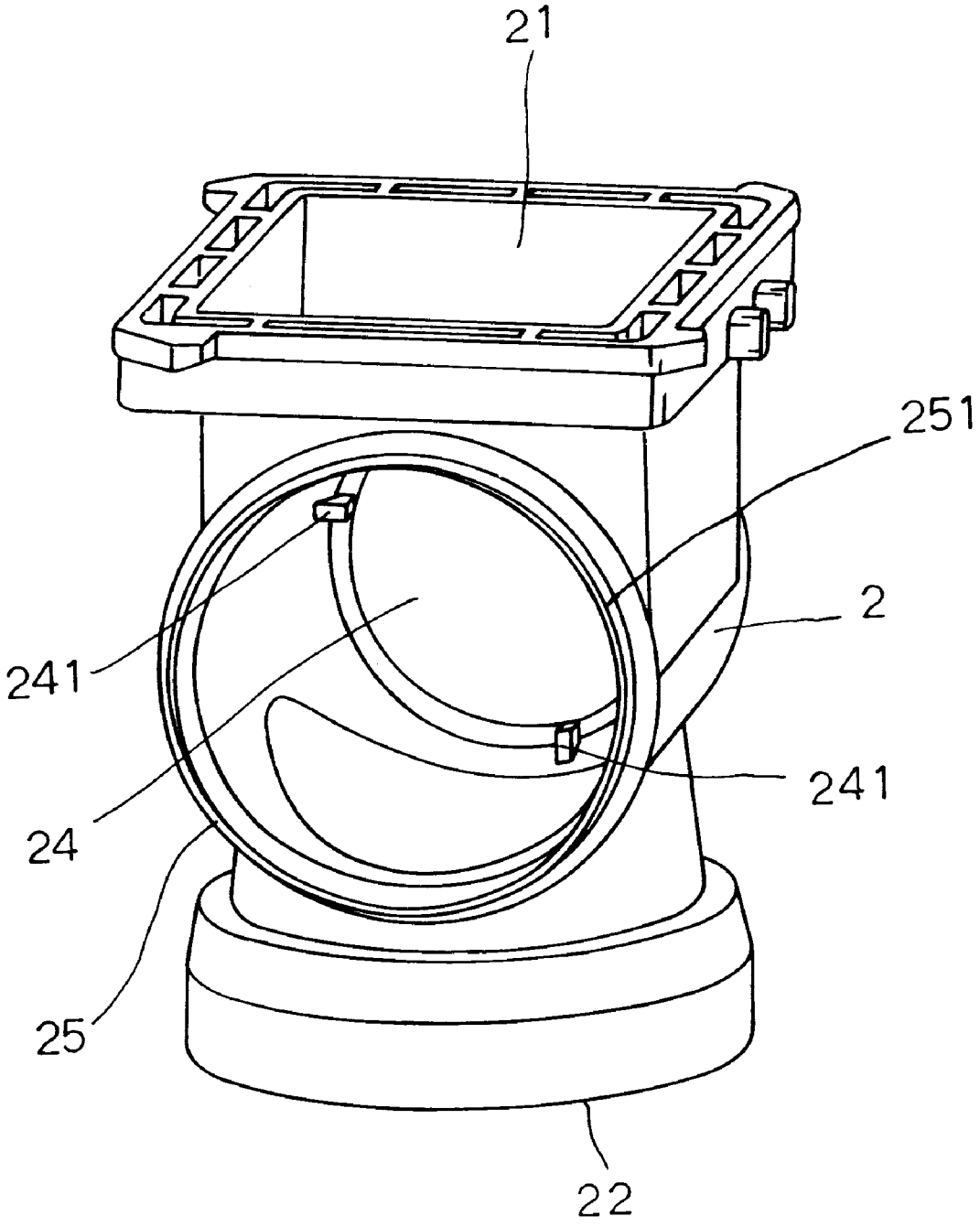
FIG. 2 is an elevational view in an enlarged scale of the connector element shown in FIG. 1.

Referring to FIG. 2 and FIGS. 1 and 4 again, the connector element 2 comprises a supply hole 21 and a coupling hole 22 longitudinally aligned at front and rear sides thereof, an inside annular coupling groove 23 disposed in the coupling hole 22 and forced into engagement with the outside annular coupling flange 13 of the container body 1, a side opening 25, an inside chamber 24 disposed in communication between the supply hole 21, the coupling hole 22 and the side opening 24, and an outside annular coupling flange 251 disposed around the side opening 25.

Figure 3:
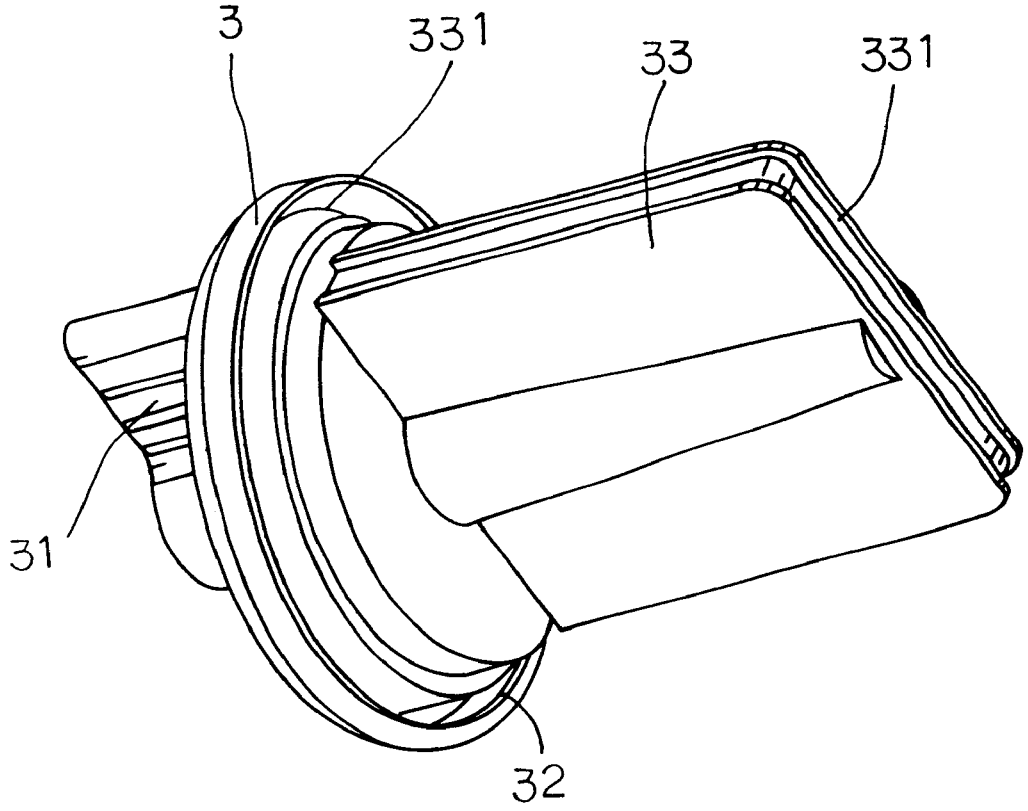
FIG. 3 is an elevational view in an enlarged scale of the rotating sealing member shown in FIG. 1.

Referring to FIG. 3 and FIGS. 1 and 4 again, the rotating sealing member 3 is mounted in the inside chamber 24, comprising a finger strip 31 disposed at its front end and suspended outside the side opening 25 of the connector element 2, a flat shutter board 33 disposed at its rear end and suspended in the inside chamber 24 inside the connector element 2, an annular coupling flange 32 disposed between the finger strip 31 and the shutter board 33 and coupled to the outside annular coupling flange 251 to secure the sealing member 3 to the connector element 2, enabling the sealing member 3 to be rotated in the inside chamber 24, and a packing rubber 34 fastened to locating grooves 331 around the periphery of the shutter board 33 and the inside of the annular coupling flange 32 to seal the gap between the shutter board 3 and the connector element 2 and to stop the developer from passing out of the side opening 25 either the passage between the supply hole 21 and the coupling hole 22 is closed or opened.

Figure 5:
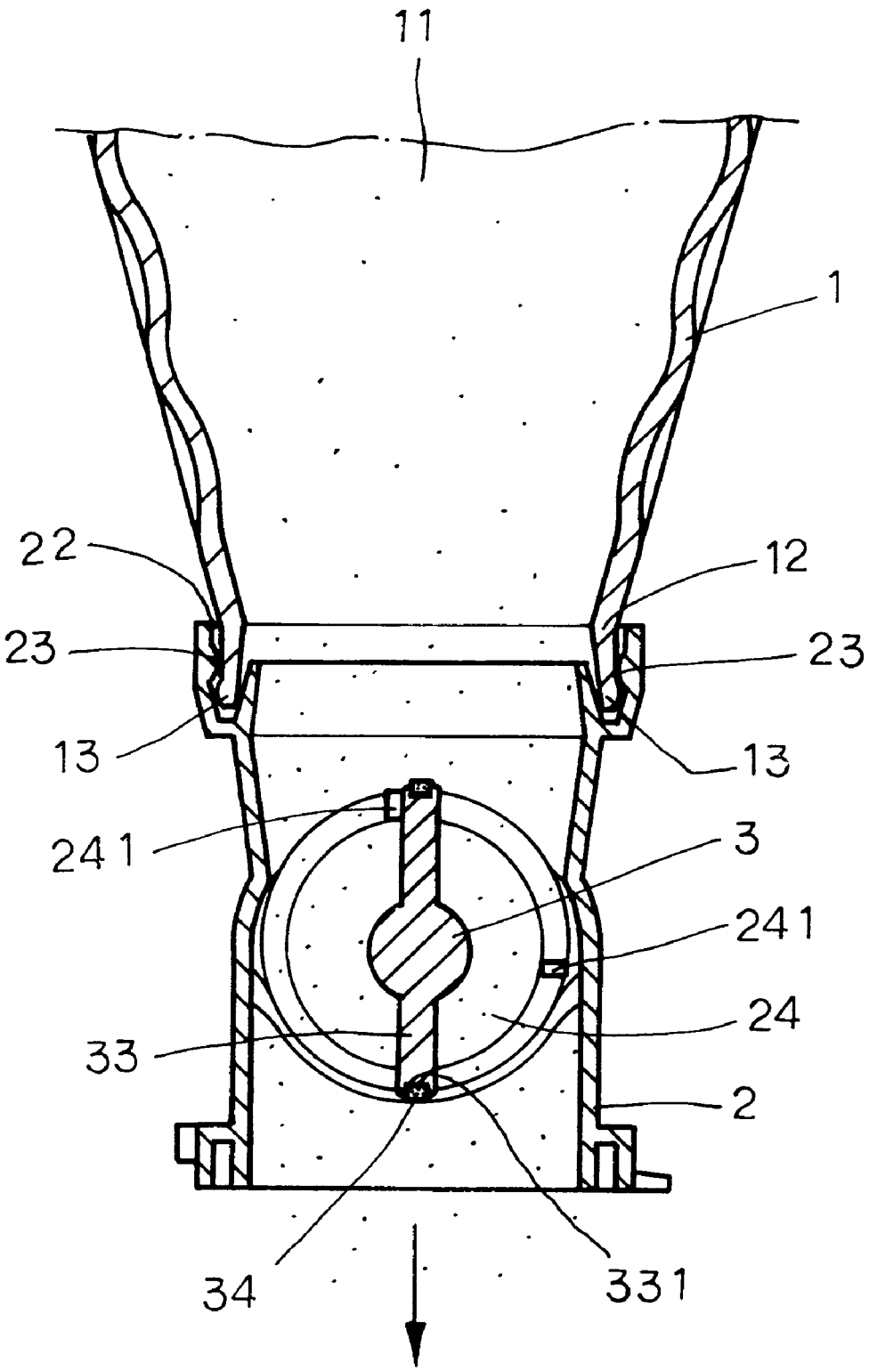
FIG. 5 is similar to FIG. 5 but showing the rotating sealing member turned to the vertical position, and the passage between the front supply hole of the connector element and the opening of the container body opened.

Referring to FIG. 5 and FIG. 4 again, after installation of the developer container in the image forming apparatus, the finger strip 31 is turned with the fingers to rotate the shutter board 33 in the inside chamber 24 between the horizontal position as shown in FIG. 4 where the passage between the supply hole 21 and the coupling hole 22 is closed, and the vertical position as shown in FIG. 5 where the passage between the supply hole 21 and the coupling hole 22 is opened for allowing the developer to be delivered out of the container body 1 to the image forming apparatus through the supply hole 21.

Referring to FIGS. 2, 4 and 5, stop blocks 241 are provided inside the connector element 2 to limit rotation of the sealing member 3 in the inside chamber 24 between the aforesaid horizontal position and vertical position.

What the invention claimed is:

1. A developer container of the type comprising:

a container body holding a developer, said container body comprising an opening at one end thereof through which said developer is supplied in and out, and an outside annular coupling flange around the opening of said container body;

a connector element connecting said container body to an image forming apparatus, said connector element comprising a rear coupling hole coupled to the outside annular coupling flange of said container body, a front supply hole disposed in communication with said rear coupling hole for guiding said developer from said container body to the image forming apparatus to which said connector element is connected, an inside chamber disposed between said front supply hole and said rear coupling hole, a side opening disposed in communication with said inside chamber between said front supply hole and said rear coupling hole, and an outside annular coupling flange disposed around said side opening; and a rotating sealing member mounted in the inside chamber in said connector element and rotated to open and close the passage between the front supply hole and rear coupling hole of said connector element, said rotating sealing member comprising a finger strip disposed outside the side opening of said connector element for operation with the hand, and a coupling flange coupled to the outside annular coupling flange around the side opening of said connecting element for enabling said rotating sealing member to be secured to said connector element and rotated in said inside chamber;

wherein said rotating sealing member comprises a flat shutter board turned with said rotating sealing member in said inside chamber between a horizontal position where said flat shutter board closes the passage between said front supply hole and said rear coupling hole to stop said developer from passing out of said container body and a vertical position where said flat shutter board opens the passage between said front supply hole and said rear coupling hole to let said developer be supplied from said container body to the image forming apparatus to which said connector element is connected, and a packing member fastened to the periphery of said flat shutter member.

2. The developer container of claim 1 wherein said connector element comprises a plurality of stop blocks inside said inside chamber to limit rotation of said rotating sealing member between said horizontal position and said vertical position.

* * * * *